US009909338B1

(12) United States Patent
Abrahams

(10) Patent No.: US 9,909,338 B1
(45) Date of Patent: Mar. 6, 2018

(54) ADJUSTABLE CABINET HANDLE

(71) Applicant: Shorna E. Abrahams, Toronto (CA)

(72) Inventor: Shorna E. Abrahams, Toronto (CA)

( * ) Notice: Subject to any disclaimer, the term of this patent is extended or adjusted under 35 U.S.C. 154(b) by 0 days.

(21) Appl. No.: 15/359,901

(22) Filed: Nov. 23, 2016

Related U.S. Application Data

(60) Provisional application No. 62/259,087, filed on Nov. 24, 2015.

(51) Int. Cl.
*E05B 1/00* (2006.01)
*E05B 5/00* (2006.01)

(52) U.S. Cl.
CPC ..... *E05B 1/0015* (2013.01)

(58) Field of Classification Search
CPC . Y10T 16/458; Y10T 16/462; Y10T 16/4644; Y10T 16/513; Y10T 16/498; A47B 95/02; A47B 95/023; A47B 2095/023; E05B 1/00; E05B 1/0015; E05B 1/0053; E05B 85/10; E05B 79/06; E05B 23/02; E05B 23/028; F25D 2400/06
See application file for complete search history.

(56) References Cited

U.S. PATENT DOCUMENTS 1,655,744 A * 1/1928 Swanby ..... H01M 2/1005 16/423
1,753,396 A * 4/1930 Witkowski ..... H01M 2/1011 16/423
2,242,461 A * 5/1941 Fisher ..... A47K 3/003 16/436
2,407,763 A 9/1946 North et al.
2,672,103 A * 3/1954 Hohmes ..... B60N 3/02 105/354
2,882,549 A 4/1959 Strauss
2,961,694 A * 11/1960 May ..... E05B 1/0015 16/412
3,075,735 A * 1/1963 Skinner ..... A47B 95/02 16/430
3,766,598 A * 10/1973 Roberts ..... A47B 95/02 16/444
4,524,483 A 6/1985 Lynham et al.
5,652,999 A * 8/1997 Jarvis ..... B25G 1/10 16/110.1
5,690,237 A * 11/1997 Marzec ..... A47K 3/003 211/105.1
5,727,858 A 3/1998 Shapiro
6,003,202 A * 12/1999 Dauterive ..... A47B 95/02 16/419
6,507,978 B1 * 1/2003 Root ..... H02B 1/26 16/410
6,554,338 B1 4/2003 Spence
(Continued)

FOREIGN PATENT DOCUMENTS

GB 2353245 A * 2/2001 ..... B29C 45/14688

*Primary Examiner* — Chuck Mah
(74) *Attorney, Agent, or Firm* — Robert C. Montgomery; Montgomery Patent & Design, LP.

(57) ABSTRACT

An adjustable cabinet handle provides a convenient means to replace or update an existing cabinet door handle. The adjustable cabinet handle includes a central handle body having mounting portions affixed to each opposing end. The center-to-center distance between the mounting portions is adjustable, thereby allowing an installer to utilize the existing mounting holes in the cabinet door to mount the new cabinet handle.

5 Claims, 6 Drawing Sheets

(56) References Cited

U.S. PATENT DOCUMENTS

| | | | | |
|---|---|---|---|---|
| 7,124,451 | B2 * | 10/2006 | Moore | A47K 3/003 211/105.1 |
| 7,861,463 | B1 * | 1/2011 | Nottage | E05B 1/0015 16/429 |
| 8,132,295 | B1 | 3/2012 | Otis et al. | |
| 8,523,126 | B2 * | 9/2013 | Garrels | A47K 17/022 211/105.1 |
| 8,533,912 | B2 * | 9/2013 | Tran | A47B 95/02 16/110.1 |
| 2005/0210683 | A1 * | 9/2005 | Philbrook | A47G 21/00 30/322 |
| 2010/0139046 | A1 | 6/2010 | Daniels et al. | |
| 2011/0179603 | A1 | 7/2011 | Edelen | |

* cited by examiner

ADJUSTABLE CABINET HANDLE

RELATED APPLICATIONS

The present invention was first described in and claims the benefit of U.S. Provisional Application No. 62/259,087 filed Nov. 24, 2015, the entire disclosures of which are incorporated herein by reference.

FIELD OF THE INVENTION

The present invention relates generally to the field of handles and more specifically relates to cabinet/drawer handles.

BACKGROUND OF THE INVENTION

Many people store clothes and other household items in cabinets, dresser drawers, armoires, and the like. These structures generally need handles in order to open and close them. During the construction of these structures by carpenters and woodworkers, must measure out the length of the handle as well as the insertion holes to keep everything in proper alignment.

However, this may be a difficult task due to the possibility of incorrect measurements and faulty measuring equipment. Therefore, it is desirable to design a handle that is self-adjustable for the purpose of adapting to a desired length of the insertion holes, and locking into place without the need of measurement.

Various attempts have been made to solve problems found in handle art. Among these are found in: U.S. Pat. No. 6,789,294 to Jeffrey J. Panek et al.; U.S. Pat. No. 2,239,798 to George A. Tinnerman; and U.S. Pat. No. 4,524,483 to Thomas F. Lynham et al. These prior art references are representative of handles.

None of the above inventions and patents, taken either singly or in combination, is seen to describe the invention as claimed. Thus, a need exists for a reliable adjustable handle system, and to avoid the above-mentioned problems.

SUMMARY OF THE INVENTION

The inventor has recognized the aforementioned inherent problems and lack in the art and observed that there is a need for an adjustable handle. It is therefore an object of the invention to provide an adjustable handle which comprises a first attachment member, a second threaded aperture disposed subjacent the first female aperture, a second attachment member and a handle body. The first attachment member comprises a first threaded aperture which is disposed within a first attachment member first side and a first female aperture which is disposed within a first attachment member second side. The second attachment member comprises a third threaded aperture which is disposed within a second attachment member first side, a second female aperture which is disposed within a second attachment member second side and a fourth threaded aperture which is disposed subjacent the second female aperture. The handle body has a first shaft at a first end and a second shaft at a second end.

The first shaft is capable of sliding engagement with the first female aperture while the second shaft is capable of sliding engagement with the second female aperture. The handle body is capable of being secured in place between the first attachment member and the second attachment member by implementation of a first set screw within the second threaded aperture and a second set screw within the fourth threaded aperture. The adjustable handle is capable of being secured to a cabinet door by fasteners which are independently secured through the first threaded aperture and the third threaded aperture.

The first and second attachment members may each be elbow shaped while the first and second shaft may each be cylindrical. The handle body, first attachment member and second attachment member may comprise rubber or metal. Any attachment member comprised of metal may have either a chrome or matte finish.

In alternate embodiment, the adjustable handle may comprise of a handle portion, a first handle extension integral with a handle portion first end, a second handle extension integral with a handle portion second end, a first nut fastener slot which is disposed within the first handle extension, a second nut fastener slot which is disposed within the second handle extension, a first threaded aperture which is disposed subjacent the first nut fastener slot and a second threaded aperture which is disposed subjacent the second nut fastener slot. The handle may be adjustably secured to a cabinet door by use of a first nut fastener which slidingly engages within the first nut fastener slot and a first cabinet aperture and a second nut fastener which slidingly engages within the second nut fastener slot and a second cabinet aperture. The handle may be secured to the cabinet door by use of fasteners which independently may be secured through the first threaded aperture and the second threaded aperture. The handle may comprise rubber or metal. A metal handle may have a chrome or matte finish.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
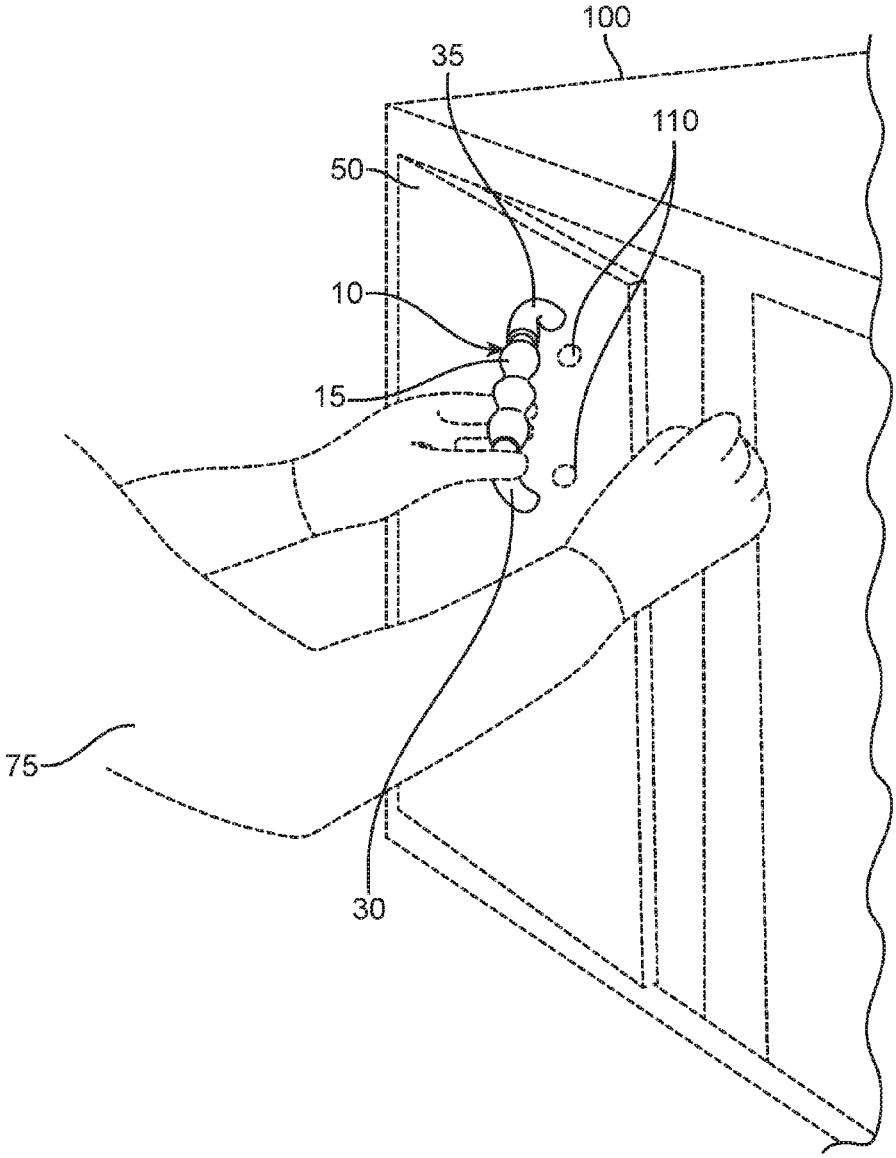
FIG. 1 is an environmental view showing installation of an adjustable cabinet handle 10 onto an existing cabinet door 50 of an existing cabinet 100, according to a preferred embodiment of the present invention.

10 adjustable handle
15 handle body
25*a* first shaft
25*b* second shaft
30 first attachment member
30*a* first attachment member first side
30*b* first attachment member second side
35 second attachment member

35*a* second attachment member first side
35*b* second attachment member second side
37*a* first female aperture
37*b* second female aperture
50 existing cabinet door
75 user
80*a* first threaded fastener
80*b* second threaded fastener
82*a* first threaded aperture
82*b* second threaded aperture
82*c* third threaded aperture
82*d* fourth threaded aperture
84*a* first set screw
84*b* second set screw
100 existing cabinet
110 existing fastener aperture
200 alternate embodiment
201 alternate handle portion
205*a* alternate embodiment first threaded aperture
205*b* alternate embodiment second threaded aperture
210*a* first handle extension
210*b* second handle extension
220*a* first nut fastener
220*b* second nut fastener
225*a* first nut fastener slot
225*b* second nut fastener slot
230 second alternate embodiment
240 third alternate embodiment

DETAILED DESCRIPTION OF THE PREFERRED EMBODIMENT

Figure 3:
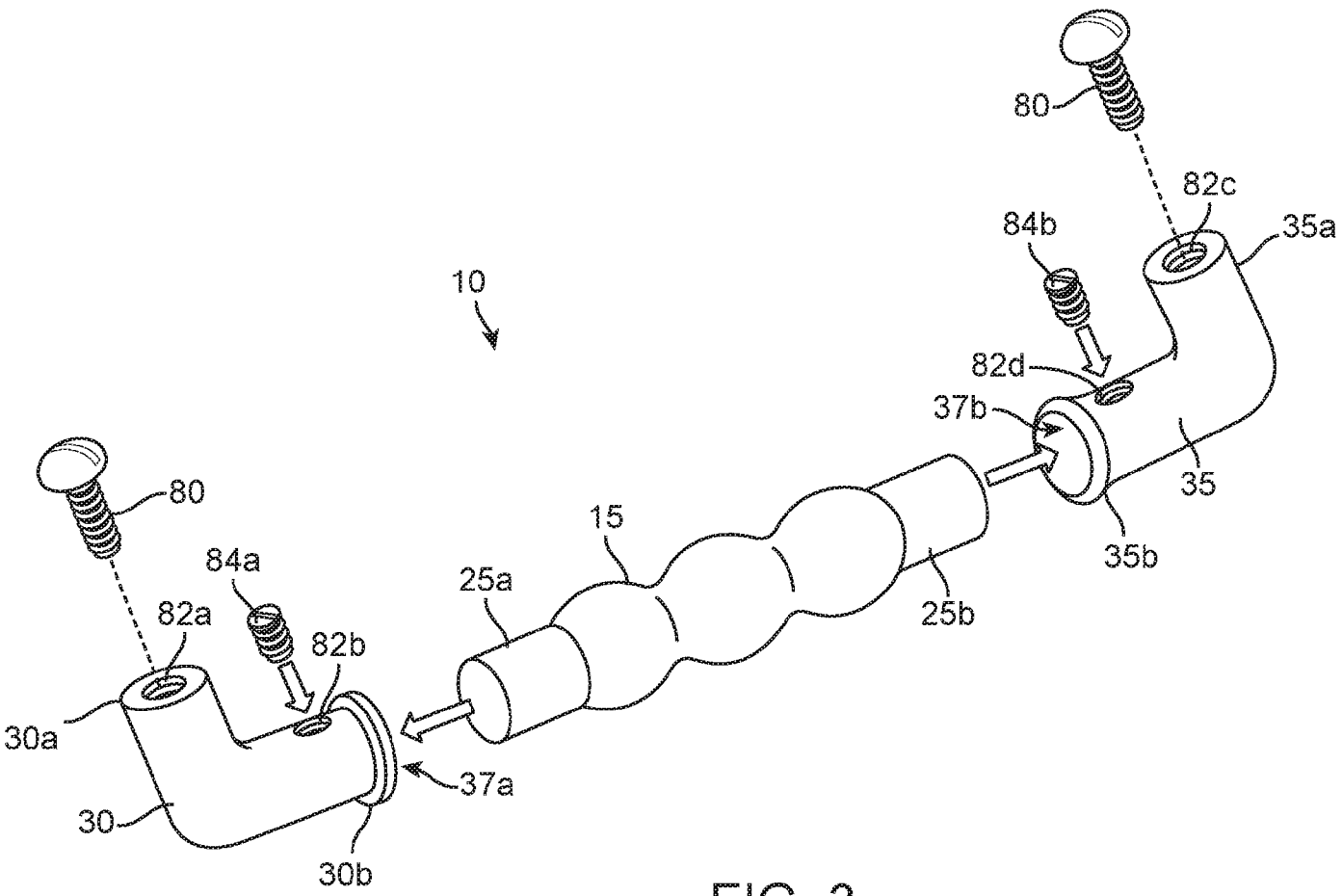
FIG. 3 is an exploded view of the adjustable cabinet handle 10, according to a preferred embodiment of the present invention.
Figure 4:
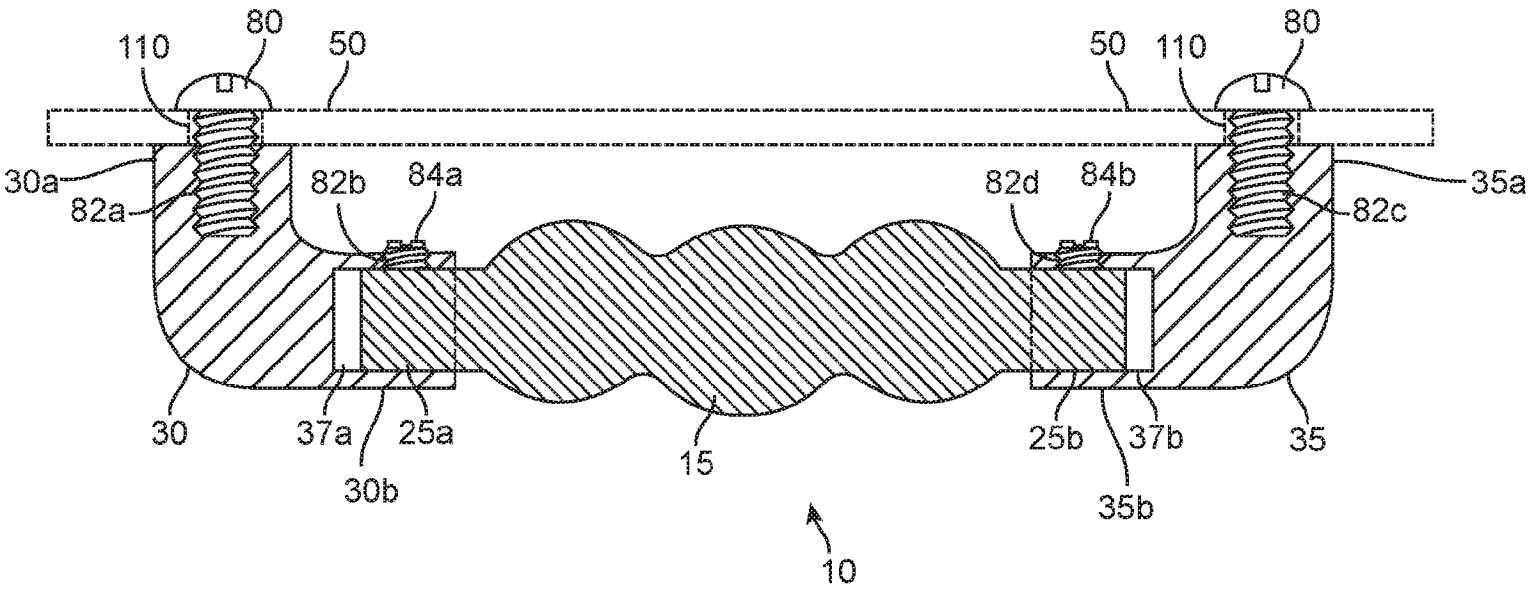
FIG. 4 is a sectional view of the adjustable cabinet handle 10 taken along section line A-A (see FIG. 2), according to a preferred embodiment of the present invention.
Figure 5:
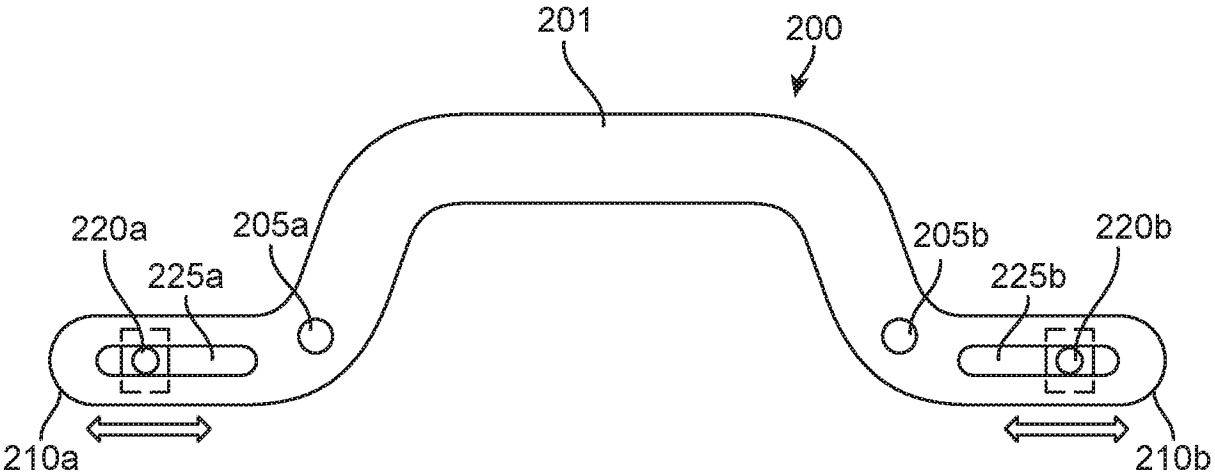
FIG. 5 is a bottom view of an alternate embodiment 200 of the present invention.

The best mode for carrying out the invention is presented in terms of its preferred embodiment, herein depicted within FIGS. 1 through 4, and in terms of an alternate embodiment, herein depicted within FIG. 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Referring now to FIG. 1, an environmental view of the system 10, according to the preferred embodiment of the present invention, is disclosed. The present invention describes an adjustable cabinet handle (herein described as the "system") 10, which provides a central handle body portion 15 having a first attachment member 30 affixed to one (1) end portion, and a second attachment member 35 affixed to the opposing end portion. The center-to-center distance between the attachment members 30, 35 may be adjusted, thereby enabling mounting the system 10 to existing fastener aperture portions 110 of an existing cabinet door portion 50 of an existing cabinet 100. It is understood that the system 10 may also be applied to other similar structures such as a drawer with equal benefit, and as such should not be interpreted as a limiting factor of the system 10. It is envisioned that multiple units of the system 10 having a particular design would be made available for purchase as a set. It is further envisioned that sets of the system 10 would be available having various handle body 15 and attachment member 30, 35 designs, materials, and decorative appearances based upon a user's preference without deviating from the teachings of the system 10, and as such should not be interpreted as a limiting factor.

A user 75, as shown here, may install the system 10 by manipulating the attachment members 30, 35 until obtaining alignment of the attachment members 30, 35 with corresponding existing fastener apertures 110 present within the existing cabinet door 50. A pair of threaded fasteners 80 may then be utilized to secure the system 10 in place (also see FIG. 4).

The system 10 may be installed on a variety of sized cabinet doors 50. The attachment members 30, 35 include respective first shaft 25*a* and second shaft 25*b* portions, respectively (see FIGS. 3 and 4). The adjustability of the shafts 25*a*, 25*b* relative to the handle body 15 permits installation of the system 10 in various configurations including straight, arcuate, and at an angle without the need to cut, drill, or measure the system 10. Once situated and fastened into place, the system 10 becomes a permanent attachment.

Figure 2:
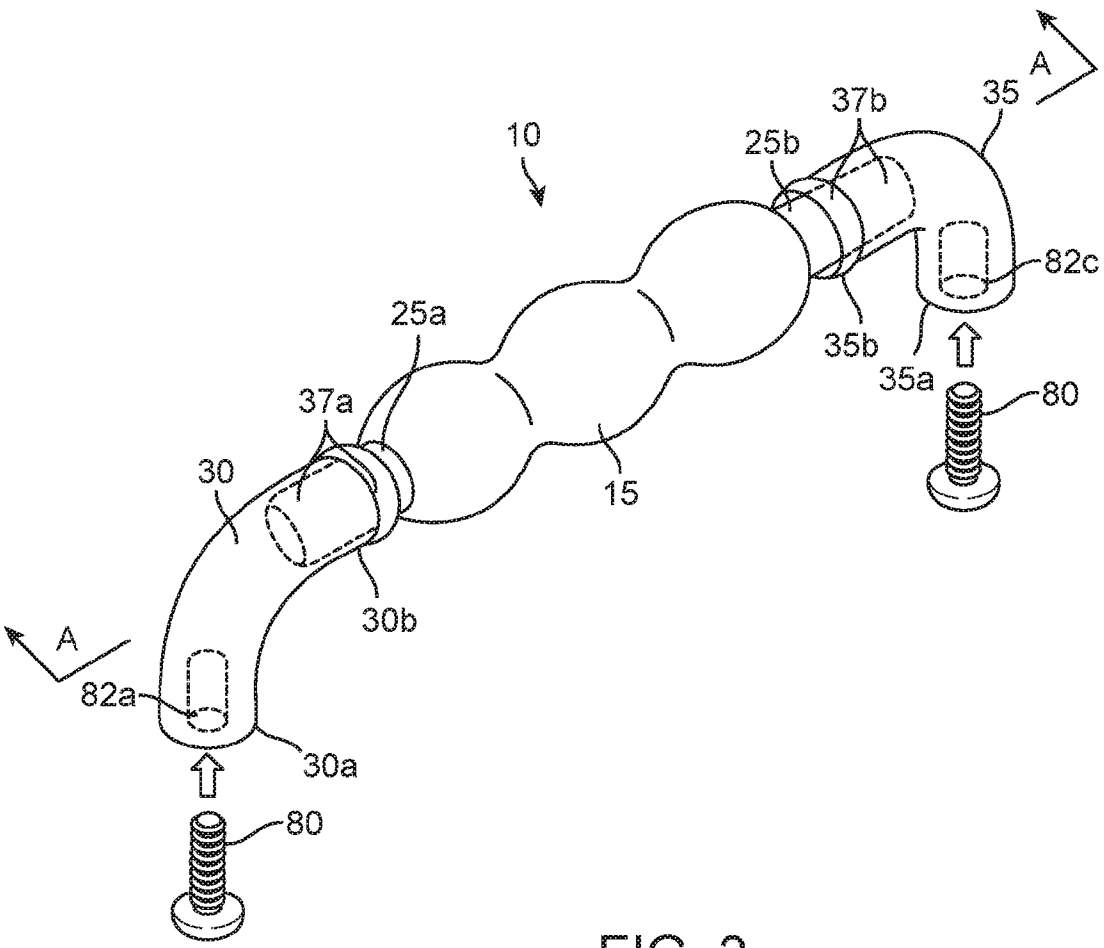
FIG. 2 is a perspective view of the adjustable handle 10, according to a preferred embodiment of the present invention.

Referring now to FIGS. 2, 3, and 4, perspective, exploded, and sectional views of the system 10, according to the preferred embodiment of the present invention, are disclosed. A particular embodiment of the system 10 is shown here having a particular handle body embodiment 15 for illustration sake, and as such should not be interpreted as a limiting factor of the system 10. The first shaft 25*a* and second shaft 25*b* are integral to the handle body 15 and are arranged in a bilateral manner, extending from opposing end portions of the handle body 15. The shafts 25*a*, 25*b* provide cylindrical shapes which slidingly engage respective first female aperture 37*a* and second female aperture 37*b* portions of the first attachment member 30, having a first side 30*a* and a second side 30*b*, and second attachment member 35, having a first side 35*a* and a second side 35*b*, portions. An embodiment of the attachment members 30, 35 is shown here having an elbow-shape design for illustration sake, and as such should not be interpreted as a limiting factor of the system 10. The attachment members 30, 35 are slidingly positioned upon the respective shafts 25*a*, 25*b* to obtain a desired center-to-center distance matching that of the existing fastener apertures 110, and secured in position via respective set screws 84*a*, 84*b* being engaged within corresponding threaded aperture portions 82*b*, 82*d* of the attachment members 30, 35. The linearly adjustable attachment members 30, 35 enable mounting the system 10 to an existing cabinet door 50 while utilizing the existing fastener apertures 110 of the existing cabinet door 50 regardless of the spacing of the existing fastener apertures 110.

The shafts 25*a*, 25*b* allow for quick accurate adjustment of the length of the system 10 without the need of measuring tools or equipment when positioning the system 10. Once the shafts 25*a*, 25*b* are correctly positioned within the respective first 37*a* and second 37*b* female apertures, the set screws 84*a*, 84*b* are installed within the second threaded aperture portions 82*b*, 82*d* located along a bottom surface of the attachment members 30, 35. The set screws 84*a*, 84*b* act to clamp onto the shafts 25*a*, 25*b*. The system 10 then becomes a permanent fixture of the cabinet door 50, or other similar structure such as a drawer.

Figure 6:
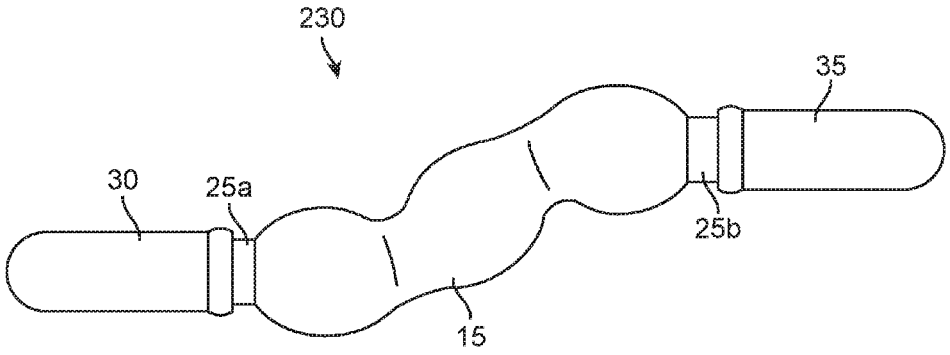
FIG. 6 is a top view of a second alternate embodiment 230 of the present invention; and, FIG. 7 is a top view of a third alternate embodiment 240 of the present invention.
Figure 7:
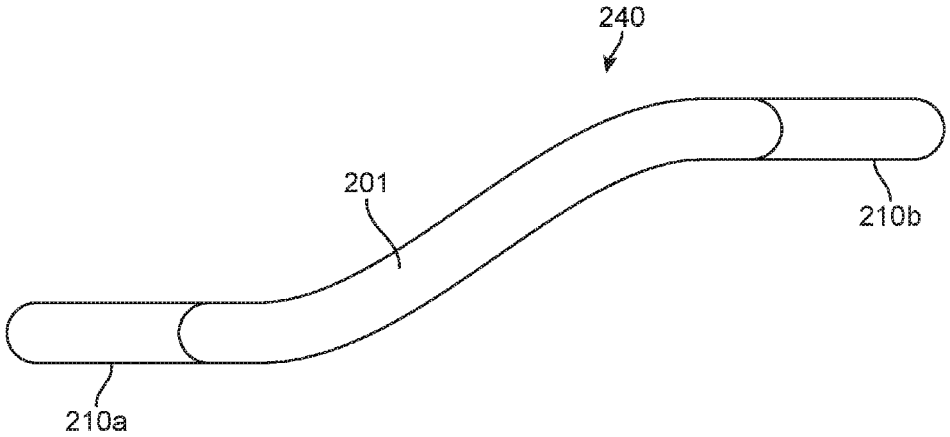

It is envisioned that the handle body 15 may comprise a rigid, semi-rigid, or flexible material, if desired. A handle body 15, first attachment member 30, second attachment member 35, or alternate embodiments 200, 230 and 240 made using a flexible material such as rubber or plastic may be manipulated to various degrees of flexion for additional installation applications such as when installing the system 10 or 200, 230 and 240 at an angle, in an arcuate configuration, or in tight areas (see FIGS. 6 and 7). The use of an elastic handle body portion 15, 201 may allow for positioning in otherwise difficult orientations. Alternatively, a handle body 15, first attachment member 30, second attachment member 35, or alternate embodiment 200 may be made of any metal suitable for such purposes such as but not limit to copper, steel, nickel, iron and brass and may having either a chrome or matte finish. Lastly, all of the forgoing elements, 15, 30, 35 and 200 may be made of any wood which is suitable for such purposes such as oak, pine, cherry, ash, maple etc.

The system 10 is envisioned to improve the installation process so that a user 75 such as a carpenter, woodworker, or do-it-yourself enthusiast may avoid lengthy unnecessary hunching and bending, thus avoiding possible injury. The design of the system 10 is envisioned to reduce the time needed to complete a prolonged assignment by minimizing required measuring.

It is understood that the existing fastener apertures 110 of the existing cabinet door 50 may be arranged vertically, horizontally, or diagonally for receiving the attachment members 30, 35 of the system 10. Multiple drawers and cabinet doors 50 may be fitted with the system 10 in a variety of positions regardless of how the structures are manufactured. The ease of installation, and the ability to install without measurement makes the system 10 ideal for the average user 75 to customize existing cabinet handles with a new design.

The exact specifications, materials used, and method of use of the adjustable handle 10 may vary upon manufacturing.

Referring now to FIG. 5, a bottom view of an alternate embodiment 200 of the present invention, is disclosed. The alternate embodiment 200 illustrated here includes a handle body 201, an integral first handle extension 210*a* and a second handle extension 210*b* portions which protrude outwardly along a common axis approximately one-half inch to one inch (½-1 in.) from opposing end portions of the alternate embodiment 200. Each handle extension 210*a*, 210*b* further includes an elongated internal nut fastener slot 225*a*, 225*b* containing an entrapped nut fastener 220*a*, 220*b*. The nut fasteners 220*a*, 220*b* are entrapped laterally within the respective nut fastener slots 225*a*, 225*b* while allowing longitudinal sliding of the nut fasteners 220*a*, 220*b*. Positioning of the nut fasteners 220*a*, 220*b* enables quick adjustment of a center-to-center distance between the nut fasteners 220*a*, 220*b*, thereby providing versatile installation onto an existing cabinet door 50 by adjusting to the center-to-center distance of the existing fastener apertures 110. The nut fastener slots 225*a*, 225*b* are envisioned to extend completely through each handle extension 210*a*, 210*b*, thereby allowing reversible mounting and engagement of the alternate embodiment 200. The alternate embodiment 200 is also envisioned to include a pair of threaded apertures 205*a*, 205*b* positioned adjacent to each nut fastener slot 225*a*, 225*b* respectively.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1.

The method of installing and utilizing the system 10 may be achieved by performing the following steps: procuring a set or desired number of units of the system 10, having a desired design based upon a user's preference; removing a desired number of existing handles from existing cabinet doors 50 and/or drawers; preparing an initial unit of the system 10 for installation by loosening the set screws 84*a*, 84*b* of each attachment member 30, 35 until the shafts 25*a*, 25*b* slide freely within the respective first female aperture 37*a* and second female aperture 37*b* portions of the attachment members 30, 35; manipulating the shafts 25*a*, 25*b* within the respective female apertures 37*a*, 37*b* until obtaining proper alignment of the threaded respective aperture portions 82*a*, 82*c* of the attachment members 30, 35 and the corresponding existing fastener apertures 110 present within an existing cabinet door 50 or drawer; tightening the set screws 84*a*, 84*b* within the threaded apertures 82*b*, 82*d* to secure the shafts 25*a*, 25*b* in position; inserting corresponding threaded fasteners 80*a* and 80*b* through a rear side portion of the existing fastener apertures 110; threadingly engaging and tightening the threaded fasteners 80*a*, 80*b* within the respective threaded apertures 82*a*, 82*c* of the attachment members 30, 35; repeating the previous steps for all remaining units of the system 10 to be installed; and, benefiting from eliminating a need to cut, drill, or take measurements while installing new adjustable handles 10 upon cabinets and/or drawers, afforded a user of the system 10.

The method of installing and utilizing the alternate embodiment 200 of the invention may be achieved by performing the following steps: procuring a desired number of units of the alternate embodiment 200; positioning an initial unit of the alternate embodiment 200 at a desired location upon the existing cabinet door 50; adjusting the nut fasteners 220 side-to-side within the nut fastener slots 225 until obtaining alignment of the nut fasteners 220 and the existing fastener apertures 110 of the existing cabinet door 50; inserting threaded fasteners 80 through a rear side portion of the existing fastener apertures 110; threadingly engaging and tightening the threaded fasteners 80 within the nut fasteners 220 of the handle extensions 210*a*, 210*b*; and, repeating the previous steps for all remaining units of the alternate embodiment 200 to be installed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An adjustable handle, comprising:

a handle portion;

a first handle extension integral with a handle portion first end;

a second handle extension integral with a handle portion second end;

a first nut fastener slot disposed within said first handle extension;

a second nut fastener slot disposed within said second handle extension;

a first threaded aperture disposed subjacent said first nut fastener slot; and, a second threaded aperture disposed subjacent said second nut fastener slot;

wherein said handle may be adjustably secured to a cabinet door by use of a first nut fastener which slidingly engages within said first nut fastener slot and a first cabinet aperture and a second nut fastener which slidingly engages within said second nut fastener slot and a second cabinet aperture; and, wherein said handle may be secured to said cabinet door by use of fasteners independently secured through said first threaded aperture and said second threaded aperture.

2. The handle of claim 1, wherein said handle comprises rubber.

3. The handle of claim 1, wherein said handle comprises metal.

4. The handle of claim 1, wherein said handle comprises a chrome finish.

5. The handle of claim 1, wherein said handle comprises a matte finish.

* * * * *